United States Patent [19]

Langer, Jr. et al.

[11] 3,999,960

[45] Dec. 28, 1976

[54] WAX CRYSTAL MODIFIERS FOR PETROLEUM OILS

[75] Inventors: Arthur W. Langer, Jr., Watchung, Plainfield; Wladimir Philippoff, Cranford, both of N.J.

[73] Assignee: Exxon Research and Engineering Company, Linden, N.J.

[22] Filed: Oct. 2, 1974

[21] Appl. No.: 511,178

Related U.S. Application Data

[63] Continuation of Ser. No. 284,995, Aug. 30, 1972, abandoned.

[52] U.S. Cl. ..... 44/62; 44/80

[51] Int. Cl.[2] ..... C10L 1/18; C10L 1/16

[58] Field of Search ..... 44/62, 80, 74, 78, 79

[56] References Cited

UNITED STATES PATENTS 3,252,771 5/1966 Clough et al. ..... 44/80 X 3,649,228 3/1972 McLaren ..... 44/62

FOREIGN PATENTS OR APPLICATIONS 1,154,966 6/1969 United Kingdom ..... 44/80

*Primary Examiner*—Floyd D. Higel
*Assistant Examiner*—Mrs. Y. Harris-Smith
*Attorney, Agent, or Firm*—B. O. Dimmick; W. Hoover

[57] ABSTRACT

Materials consisting essentially of hydrocarbons with at least two straight chain alkyl groups are useful as wax crystal modifiers in petroleum oils, particularly middle distillate fuel oils such as heating oils and diesel fuels. These materials can be prepared by dimerizing α-olefins, which dimers can be used per se, or can be further derivatized, e.g. polymerized, alkylated on to an aromatic molecule, etc.

5 Claims, No Drawings

WAX CRYSTAL MODIFIERS FOR PETROLEUM OILS

This is a continuation of application Ser. No. 284,995, filed Aug. 30, 1972, now abandoned.

BACKGROUND OF THE INVENTION

1. Field of the Invention

The invention relates to materials consisting essentially of hydrocarbon characterized by at least two chain linear alkyl groups, which materials are useful as wax crystal modifiers for petroleum oils, such as pour depressants, flow improvers, etc. for fuel oils.

2. Prior Art

Kerosene, which acts as a solvent for n-paraffin wax, has traditionally been a component of middle distillate fuel oils. Recently, with the increased demand for kerosene for use in jet fuels, the amount of kerosene used in middle distillate fuel oils has decreased. This, in turn, has frequently required the addition of wax crystal modifiers, e.g. pour point depressant additives, to the fuel oil to make up for the lack of kerosene.

The more effective of these distillate oil pour depressants are copolymers of ethylene with various other monomers, e.g. copolymers of ethylene and vinyl esters of lower fatty acids such as vinyl acetate (U.S. Pat. No. 3,048,479); copolymers of ethylene and alkyl acrylate (Canadian Pat. No. 676,875); terpolymers of ethylene with vinyl esters and alkyl fumarates (U.S. Pat. Nos. 3,304,261 and 3,341,309); polymers of ethylene with other lower olefins, or homopolymers of ethylene (British Pat. Nos. 848,777 and 993,744); chlorinated polyethylene (Belgium Pat. No. 707,371 and U.S. Pat. No. 3,337,313); etc.

SUMMARY OF THE INVENTION

As opposed to the ethylene polymers of the aforesaid prior art, the present invention relates to essentially hydrocarbon materials, e.g. compounds, having at least two long chain linear alkyl groups per moiety, which can be readily prepared by dimerizing $\alpha$-olefins, which dimers in turn can be further derivatized. Many of these materials are effective as pour point depressants, and in addition are also effective in controlling the particle size of the wax crystals that form in the fuel. They may be used alone or in combination with conventional polymeric additives, such as the aforesaid ethylene polymers of the prior art. The present invention also includes fuel oil compositions comprising a major proportion of a middle distillate fuel boiling in the range of about 250° to about 900° F. (ASTM-D-86), and about 0.01 to 2.0, preferably 0.05 to 1.0 wt. % of said material as a wax crystal modifier.

The Hydrocarbon Materials

These materials include compounds represented by the general formula:

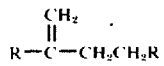

wherein the R groups are predominantly linear alkyl groups. These materials can be prepared by dimerizing linear $\alpha$-olefins, e.g. with aluminum trialkyl, aluminum dialkyl hydride catalysts or other organometallic catalysts. Once the dimerized olefin is formed, it in turn can be used per se as the wax crystal modifier, or its effectiveness can frequently be further improved by using the remaining unsaturation in the olefin dimer to produce either low molecular weight polymers, alkylated aromatics, or other derivatives from addition to the double bond such as halides, esters, ethers, amines, mercaptides, etc. The formation of said dimers, polymers and alkylated aromatics is illustrated by the following reactions:

Formation of Olefin Dimer

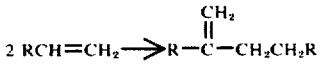

Polymerization of Olefin Dimer

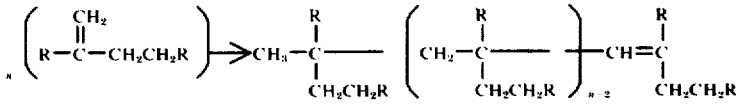

Alkylation of Aromatics with Olefin Dimer

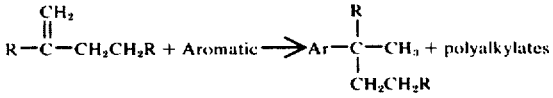

In the above reactions, the R groups are $C_{14}$ to $C_{40}$, preferably $C_{16}$ to $C_{32}$, predominately linear alkyl groups and n is 2 to 50. Some skeletal and double bond isomers are also produced in these reactions. Products of the above three reactions are effective as wax crystal modifiers. While it is not known with certainty, it is believed that the straight chain linear alkyl groups are in effect wax-like segments which act as nucleating agents and are incorporated in a growing wax crystal. Details of these reactions follow:

Formation of Olefin Dimer

The dimerization reaction can be carried out with an aluminum alkyl catalyst, preferably a trialkyl aluminum or di-alkyl aluminum hydride, and most preferably tri-isobutyl aluminum or di-isobutyl aluminum hydride, wherein said alkyl groups are $C_2$ to $C_{30}$. This reaction is well known in the art and has been described in various publications such as: K. Ziegler, Brennstoff — Chem. 33, 193 (1952); Angew. Chem. 64, 323 (1952).

A preferred dimerization can be carried out by heating the long chain alpha monoolefin with about 0.1 to 10, preferably 1 to 5, mole %, based on the moles of olefin used, of aluminum alkyl catalyst at a temperature of about 100° to 250° C., preferably 150° to 200° C., for a time of about 1 to 40, preferably 5 to 30, hours to form the dimer product.

Usually the dimerization is carried out under an inert atmosphere by blanketing the reaction with nitrogen, argon, etc. or by blowing an inert gas through the reaction mixture. After the reaction is completed, the remaining aluminum catalyst can be removed simply by dissolving the reaction product in a suitable solvent such as a light hydrocarbon, e.g. hexane, cyclohexane, benzene, etc., adding water to convert the catalyst to the hydroxide, and then filtering to remove the aluminum catalyst. Alternatively, it can be removed by filtration through clay or other adsorbents. The resulting dimer product can be used per se or it can be further purified, as for example by distillation, in order to remove any volatiles or undimerized olefin. In practical use, however, the crude dimer material itself can be used without further purification and will usually consist predominantly of dimer, together with minor amounts, e.g. less than 20 wt. %, based on said final product, of undimerized olefin.

Polymerization of Olefin Dimer

The olefin dimers, produced as above, can be polymerized with any conventional strong acid catalyst such as Lewis acids or protonic acids, such as aluminum chloride, $BF_3$, $FeCl_3$, $TiCl_4$, $H_2SO_4$, $HClO_4$. Any conventional co-catalyst may be used with the Lewis acids, e.g. water, protonic acids, alkyl halides, etc. Usually, the polymerization will be carried out in a solvent such as a hydrocarbon solvent, e.g. heptane, hexane, etc. or inert polar solvents such as methylene chloride, methyl chloride, nitromethane, nitrobenzene, mono- and polychlorobenzenes, etc. 0.2 to 20, preferably 1 to 10, mole % of the catalyst, based on the olefin dimer, is added to the dimer dissolved in the solvent, and the reaction mixture is maintained about −50° to +100° C., preferably 0° to 50° C. for about 0.1 to 10, preferably 0.5 to 5, hours in order to form the polymer. After the polymerization is completed the material can be purified by precipitation with alcohol, or other suitable non-solvents, and washing to remove catalyst residues. Hydrocarbon soluble polymers are also easily purified by washing a hydrocarbon solution thereof, with aqueous caustic, drying the solution and stripping the hydrocarbon solvent. Polymers prepared in the foregoing manner can have molecular weights ranging from about 500 to 10,000, usually about 500 to 3,000.

Alkylation of Aromatics with Olefin Dimer

The dimer, or even the aforesaid polymerized dimer, can be used to alkylate aromatics. Such aromatics can have about 1 to 3 benzene rings, which in turn can have 0 to 3 alkyl groups, or other substituents, per ring. Alkyl substituents may contain 1 to 20 carbon atoms. Other substituents include OR, $NR_2$, F, Cl, Br, $NO_2$, esters, etc. Examples of such aromatic materials include benzene, naphthalene, phenanthrene, ortho xylene, tertiary butyl benzene, diphenyl, diphenyl ether, chlorobenzene, m-diphenoxybenzene, triphenylmethane, nitrobenzene, dimethylaniline, octadecylbenzoate, etc.

General procedures for alkylating aromatics with olefinic materials are known in the art. Usually, the alkylation can be carried out by reacting 1:50 to 5:1, preferably 1:10 to 2:1, molar proportions of the olefin dimer or olefin polymer, per molar proportion of the aromatic material, depending upon the number of alkyl groups desired. This reaction can be carried out in the presence of a Friedel-Crafts catalyst, normally using a solvent, by reacting the dimer and the aromatic material at a temperature of about 0° to 150° C., preferably 20° to 100° C. for about 0.1 to 10, preferably 0.2 to 4, hours.

The Friedel-Crafts catalysts will normally be used on the basis of about 0.001 to 0.1, preferably 0.01 to 0.05, molar proportions of catalyst per mole of the aromatic material. Examples of specific suitable catalysts include $AlCl_3$, $FeCl_3$, $AlBr_3$, $BF_3$, $SnCl_4$, $SbF_5$, etc., and strong protonic acids such as $H_2SO_4$, HF, etc.

The reaction will usually be carried out in the presence of an inert solvent, preferably a volatile solvent such as paraffins, isoparaffins, naphthenes, methylene chloride, nitromethane, etc. When monoalkylation is desired, an excess of the aromatic compound is generally the preferred solvent. In some cases it is also possible to carry out the reaction in the absence of added solvent.

A convenient way of carrying out the polymerization is by dissolving the olefin in a solvent and continuously adding the solution of the olefin to the reaction vessel containing more solvent, the aromatic and the catalyst. Additional catalyst can be added during the course of the reaction, or periodically during the reaction, so as to generally keep the amount of the olefin dimer and the amount of catalyst roughly the same during the course of the reaction. The alkylation can be carried out so as to attach about 1 to 5 molar proportions, preferably 1 to 2 molar proportions, of the olefin dimer per molar proportion of the aromatic material reacted.

Normally the amount of solvent will be about 0 to 95, preferably 50 to 90, parts by weight based upon 100 parts by weight of the aromatic material to be alkylated. Alternatively to using a volatile solvent, a mineral lubricating oil can be used, preferably one free of aromatic saturation, such as a white oil, so as not to interact with the reactants. When using an oil as solvent, the reaction product can be simply left in the oil to thereby form a concentrate for later use as an oil additive. However, if desired, the resulting product can be purified by distilling off the solvent, removing the catalyst by neutralization with caustic and then filtering.

In some cases it will be advantageous to first chlorinate the olefinic material in order to facilitate its reaction with the aromatic. This, in turn, can be done by saturating an olefinic material with dry hydrogen chloride gas, usually in the presence of a solvent such as ethyl ether. This reaction is usually carried out at moderate temperatures of about −50° to +50° C., preferably 0° to 30° C., by simply blowing the HCl gas through either the dimer per se or a solution of the dimer in a solvent, for example, 5 to 50 wt. % dimer dissolved in the solvent. The solvent, of course, will be one which will not react with the hydrochloric gas.

The Distillate Fuels

The distillate fuel oils have boiling ranges within the limits of about 250° to about 900° F. The fuel oil can comprise straight run, or virgin gas oil, or cracked gas oil, or a blend in any proportion of straight run and thermally and/or catalytically cracked distillates. The most common petroleum middle distillate fuels are kerosene, diesel fuels, jet fuels and heating oils. The low temperature flow problem is most usually encountered with diesel fuels and with heating oils.

A representative heating oil specification calls for a 10% distillation point no higher than about 440° F., a 50% point no higher than about 520° F., and a 90% point of at least 540° F. and no higher than about 640° to 650° F., although some specifications set the 90% point as high as 675° F.

A representative specification for a diesel fuel includes a minimum flash point of 100° F. and a 90% distillation point between 540° and 640° F. (See ASTM Designations D-496 and D-975).

An example of a higher boiling fuel is a high cloud point diesel fuel having an initial boiling point of about 350° F., a 90% distillation point of about 733° F. and a final boiling point of about 847° F. (ASTM-D-1160).

The additives of the invention may be used alone as the sole oil additive, or in combination with other oil additives such as other pour depressants or dewaxing aids; corrosion inhibitors; antioxidants; sludge inhibitors; etc.

The invention will be further understood by reference to the following examples which include preferred embodiments of the invention.

Additive 1

A dimer of a $C_{18}$ α-olefin was prepared as follows:

75.8 gms. (.30 mole) of a commercial octadecene-1 consisting: of 93 wt. % octadecene-1, 0.7 wt. % of $C_{16}$ α-olefin, 1.3 wt. % $C_{20}$ α-olefin, and 4.7 wt. % of a $C_{18}$ paraffin or Type III olefin, was added to a 250 ml. flask equipped with a reflux condenser and magnet for stirring. 2.13 gms. (0.015 mole) of a pure aluminum diisobutyl hydride was added as catalyst. Nitrogen was bubbled through the flask to exclude air, while heating in an oil bath at 160° F. for 24 hours. Following this, the flask was cooled to 100° C. and then 100 ml. of normal-heptane ($C_7$) was slowly added to the flask. This was followed by the addition of 10 ml. of water to hydrolyze the catalyst and convert it into a hydrogen insoluble product. The flask was maintained at 100° C. for about 15 minutes while stirring, following which the contents of the flask was then filtered to remove insoluble catalyst. The solution was then stripped in a short path still to a vapor temperature of 200° C. at 0.2 mm. mercury pressure.

The bottoms of 54.3 gm. was obtained as a white solid material having a melting point of about 44.5° to about 45.5° C. Analysis showed said material was 93.2 wt. % $C_{36}H_{72}$ having predominantly the structure:

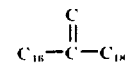

wherein said $C_{16}$ and $C_{18}$ were straight chain $C_{16}$ and $C_{18}$ alkyl groups. This product is hereinafter abbreviated as $(C_{18})_2$. The bottoms material had a molecular weight of 498 which was in close agreement to the calculated molecular weight of 504.

The aforesaid analysis showed said bottoms consisted on a weight percent basis of 0.8% $C_{18}$; 0.2% $C_{20}$; 0.2% of $C_{22}$; 1:1% of $C_{34}$; 93.2% of $C_{36}$; 3.0% of $C_{38}$; and 1.5% of $C_{54}$.

Additives 2 to 9

A series of dimers was prepared from various α-olefin feeds in the same general manner as that of Additive 1.

The reaction conditions and olefin feeds used to prepare Additives 1 to 9, are summarized in the following Table I. The products, i.e. Additives 1 to 9, were of high purity, that is at least 97 wt. % dimer, of which at least 89 wt. % of the products prepared was the dimer of the carbon number indicated and the remainder was analogous dimers derived from the other olefin impurities in the feed.

TABLE I

Preparation of Olefin Dimers

| | ADDITIVE | | | | |
|---|---|---|---|---|---|
| | 1 | 2 | 3 | 4 | 5 |
| Gm. Olefin | 75.8 $C_{18}$ | 67.3 $C_{12}$ | 56.0 $C_{18-24}$ | 106.0 $C_{19}$ | 84.2 $C_{20}$ |
| Gm. $Al(i\text{-}Bu)_2H$ | 2.13 | 2.84 | 1.42 | 4.26 | 2.13 |
| Temp., ° C. | 160 | 160 | 170 | 160 | 160 |
| Time, hr. | 24 | 24 | 24 | 24 | 24 |
| Product | $(C_{18})_2$ | $(C_{12})_2$ | $(C_{18-24})_2$ | $(C_{19})_2$ | $(C_{20})_2$ |
| | 6 | 7 | 8 | 9 | |
| Gm. Olefin | 92.6 $C_{22}$ | 89.8 $C_{16}$ | 95.3 $C_{17}$ | 106.6 $C_{19}$ | |
| Gm. $Al(i\text{-}Bu)_2H$ | 2.13 | 2.84 | 2.84 | 2.84 | |
| Temp., ° C. | 160 | 160 | 160 | 160 | |
| Time, hr. | 24 | 24 | 24 | 24 | |
| Product | $(C_{22})_2$ | $(C_{16})_2$ | $(C_{17})_2$ | $(C_{19})_2$ | |

Note: The $C_{18-24}$ olefin consisted of a mixture of even-numbered α-olefins having a number average molecular weight of 327 and a melting range of 79-85° F.

Additive 10 — Polymerized $C_{19}$ Dimer

This additive was prepared by dimerization of $C_{19}$ olefin followed by polymerization.

10.7 gm. of the $(C_{19})_2$ product of Additive 4 (equivalent of 0.02 mole and 50 ml. of normal heptane were added to a 250 ml. 2-neck flask equipped with a thermometer and reflux condenser. The resulting mixture of heptane and olefin dimer was heated sufficiently to dissolve the dimer in the heptane and then 50 ml. of methylene chloride and one drop of t-butyl chloride were added as co-catalyst for the aluminum chloride. The flask was then cooled until the olefin dimer began crystallizing from the solution. Then 0.133 gm. of aluminum trichloride was added as catalyst and the reaction mixture was maintained for about 4 hours at temperatures in the range of about 8° to about 12° C. 100 ml. of isopropanol was then added for the purpose of quenching and extracting catalyst residues, whereupon the yellow color of the reaction mixture became white.

The mixture was filtered through filter paper. The precipitate recovered from the filtration was the product and it had a number average molecular weight by Vapor Pressure Osmometry (VPO) of 809. The product has an average carbon content of 57.7 carbons per molecule, which calculates to about 48.1 wt. % of unpolymerized $C_{38}$ and 51.9 wt. % of $C_{76}$ which is material of the formula:

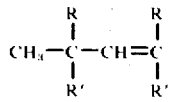

wherein R is a $C_{17}$ straight chain alkyl grop and R' is a $C_{19}$ straight chain alkyl group.

Additives 1, 4, and 10 above were then added, by simple mixing, in varying amounts to a No. 2, home heating oil which had an ASTM pour point of 0° F., a boiling range of about 350° F. to 630° F., and an aniline point of about 130° F. and which consisted of about 80 wt. % of cracked stock and about 20 wt. % of virgin gas oil. The resulting blends were then tested for ASTM D-97-66 pour point.

The results of the tests are summarized in the following Table II:

TABLE II

| Additive | Structure | Wt. % | ASTM Pour, ° F. |
|---|---|---|---|
| None | — | — | 0 |
| 1 | $(C_{18})_2$ | 0.3 | −35 |
| 4 | $(C_{19})_2$ | 0.6 | -10 |
| 10 | 48% $(C_{19})_2$ + 52% $(C_{20})_2$ | 0.6 | -50 |

As seen by the preceding Table I, the olefin derivatives were effective in reducing the pour point of the oil.

Additive 11

Alkylation of diphenyl ether with Additive 9, i.e. dimerized $C_{16}$ α-olefin, was carried out as follows: To a 200 ml. 3-neck flask equipped with a reflux condenser with nitrogen sweep, thermometer, dropping funnel and magnetic stirrer, were charged 100 ml. of diphenyl ether and 1.08 gm. of aluminum chloride (0.008 molar equivalent) dissolved in 10 ml. of nitromethane. Then, through the dropping funnel was added dropwise to the above solution, over a period of about 2 hours while maintaining the flask at 26° C., a total of 17.95 gm. (0.04 mole) of said $C_{32}$ dimer dissolved in 80 ml. of diphenyl ether. At the end of this 2 hour period then another 1.08 gm. of aluminum trichloride was added.

The reaction mixture was then heated for an additional 2 hours at 26° C., and then 10 ml. of $H_2O$ was added and the mixture was transferred into a separating funnel where 100 ml. of normal heptane was added. The product was washed twice with dilute aqueous potassium carbonate ($K_2CO_3$) and once with $H_2O$ and then dried over $K_2CO_3$. The resulting material was stripped at a pot temperature of about 151° C. under about 0.03 mm. Hg. pressure to give 23.1 gm. of bottoms which was a light yellow liquid. The theoretical yield was 24.75 gm. The melting point of the material was about 10.5° C. A gel chromotography analysis indicated that the product contained about 14 wt. % of unreacted $C_{32}$ dimer, about 85 wt. % of the diphenyl ether alkylated with the dimerized $C_{16}$ α-olefin and about 1% of dialkylate, i.e. diphenyl ether with two $C_{32}$ groups per molecule.

Additives 12 to 18

Following the same general procedure used for Additive 11, the diphenyl ether was alkylated with a series of olefin dimers.

The following Table III sets forth the reaction conditions and the reactants used to prepare Additives 11 to 18. In some cases, molecular weights by Vapor Pressure Osmometry (VPO) were run and melting points (M.P.) were determined.

TABLE III

| Direct Alkylation of Diphenyl Ether with Olefin Dimer | ADDITIVE | | | | | |
|---|---|---|---|---|---|---|
| | 11 | 12 | 13 | 14 | 15 | 16 |
| Dimer | $C_{32}$ | $C_{34}$ | $C_{36}$ | $C_{38}$ | $C_{40}$ | $C_{44}$ |
| Gm. Dimer | 17.95 | 19.07 | 10.1 | 21.32 | 11.2 | 12.3 |
| ml. initial diphenyl ether | 100 | 100 | 50 | 100 | 50 | 50 |
| ml. added diphenyl ether | 80 | 80 | 40 | 80 | 40 | 40 |
| gm. $AlCl_3$ initial | 1.08 | 1.08 | .54 | 1.08 | .54 | .54 |
| gm. $AlCl_3$ added | 1.08 | 1.08 | .54 | 1.08 | .54 | .54 |
| ml. Nitromethane | 10 | 10 | 5 | 10 | 5 | 5 |
| Temp., ° C. | 26 | 27 | 25-28 | 25-29 | 27-30 | 25-30 |
| Time, hrs. | 4 | 4 | 4 | 4 | 4 | 4 |
| Mn(VPO) | — | — | 578 | 657 | 676 | 785 |
| M.P., ° C. | 10.5 | 11 | 21.5 | 26 | 24-28 | 31-32 |
| Calc. Mn | — | — | — | 703 | 731 | 787 |

Additive 19

The tertiary-chloride of the dimerized $C_{19}$ α-olefin was prepared as follows:

A 1 liter 2-neck flask equipped with a magnetic stirrer, reflux condenser, thermometer and gas inlet bubbler was charged with 46 gm. of the dimerized $C_{19}$ α-olefin (0.0863 mole), and 200 ml. of ethyl ether. The resulting mixture was then cooled until crystals appeared while saturating with HCl gas being charged through the gas inlet bubbler. At 25° C. the mixture turned cloudy and a small amount of solid began to come out of the solution. The temperature was maintained in the general range of about 16° to 30° C. for about another 45 minutes and then 2 ml. of triethyl amine was added as catalyst. The reaction was then continued for about another 3½ hours, following which the mixture was allowed to warm up to room temperature and to remain over the weekend at room temperature in the presence of HCl. The material was then swept with nitrogen gas and some of the ether in the container was stripped off with a water pump along with some of the HCl. The remaining material was then transferred into a flask and vacuum dried at 50° C. to give 51.7 gm. of material which was then dissolved in n-heptane, washed once with very dilute HCl and twice with water. The material was then dried over $K_2CO_3$ and vacuum stripped in a rotary evaporator at about 30° C. under vacuum from a water pump to finally give 49.3 gm. of $C_{38}$ tertiary chloride as opposed to a theoretical yield of 49.29 gm.

The t. chloride was then used to alkylate benzene as follows:

2.66 gm. (0.002 mole) of aluminum trichloride, and 0.78 gm. (0.01 mole) of benzene dried over $CaH_2$, were added to the flask (as described above) with 20 ml. of normal heptane. Added through the condenser were 10.7 gm. (0.02 mole) of the aforesaid $C_{38}$ tertiary-chloride dissolved in 40 ml. of normal heptane. After a period of about 1 hour and 5 minutes at 25° C. to 28° C., the heat was turned on and the material was heated to 50° C. for a few minutes whereupon a deep amber color formed. The pressure was reduced to 150–60 mm. Hg. for 30 minutes, and then the flask was allowed to cool to 25°–27° C. 10.46 gm. of product was obtained which an infrared analysis showed to be mainly paradialkylate with some mono-alkylate.

Additives 20 to 25

Following the general procedures outlined above, a series of tertiary olefin dimer chlorides were prepared which were used to alkylate various aromatic materials such as diphenyl ether (DPE), benzene (B), etc. using either $AlCl_3$ or $FeCl_3$ as catalyst.

Additive 26

To a 100 ml. flask were charged 7.87 gm. (0.03 mole) of m-diphenoxybenzene (mDPB) and 5.33 gm. (0.01 mole) of $C_{38}$ dimer. The flask was placed in a 25° C. water bath. 1.33 gm. (0.01 mole) $AlCl_3$ as catalyst and 2 drops of $CHCl_3$ as cocatalyst were added. After 1 hour at 25° C., the temperature was raised to 48° C. which was held for about 35 minutes. The mixture was next cooled to room temperature, and dilute aqueous NaOH and a few drops of methyl alcohol were added to improve catalyst removal. The mixture was washed twice with dilute NaOH, once with water, and then dried over $K_2CO_3$. The solvent was stripped off on a rotary evaporator. The residue was then distilled to obtain 6.2 gms. of bottoms at a pot temperature of 206° C. at 0.02 mm. Hg. pressure.

Additives 27 to 30

In the general manner as above, Additives 27 to 30 were prepared. In the case of Additives 27 and 30, a large excess of the aromatic, i.e. ortho xylene, was used in order to favor monoalkylation. Also in making Additives 27, 28 and 30 nitromethane was used to dissolve the $AlCl_3$ because it is known to moderate the Lewis acidity. In making Additive 29, heptane was used as a solvent.

The general conditions of preparing Additives 26 to 30 are summarized in Table V which follows:

TABLE IV

| | Direct Alkylation of Aromatics with Olefin Dimer | | | | |
|---|---|---|---|---|---|
| | ADDITIVE | | | | |
| | 26 | 27 | 28 | 29 | 30 |
| Dimer | $C_{38}$ | $C_{44}$ | $C_{38}$ | $C_{38}$ | $C_{36-48}$ |
| gm. Dimer | 5.33 | 12.3 | 5.33 | 5.33 | 8.0 |
| Aromatic* | mDPB | oX | TPM | 2POB | oX |
| Amount Aromatic | 7.87 gm. | 90 ml. | 9.77 gm. | 7.30 gm. | 90 ml. |
| ml. nitromethane | — | 5 | 5 | — | 5 |
| gm. $AlCl_3$ (Total) | 1.33 | 1.08 | 1.08 | 1.33 | .6+ |
| ml. monochlorobenzene (Total) | — | — | 50 | — | — |
| heptane, ml. | 50 | — | — | 40 | — |
| Temp., ° C. | 25–48 | 25 | 25 | 25–46 | 50–53 |
| Time, min. | 105 | 330 | 240 | 150 | 330 |

*Aromatic-
mDPB - m-diphenoxybenzene
oX - ortho xylene
TPM - triphenylmethane
2POB - 2-phenyloxybiphenyl The conditions of preparation of Additives 19 to 25 are summarized in Table IV which follows:

TABLE IV

| | Alkylation with Tertiary Olefin Chloride from Dimerized Olefin | | | | | | |
|---|---|---|---|---|---|---|---|
| | ADDITIVE | | | | | | |
| | 19 | 20 | 21 | 22 | 23 | 24 | 25 |
| Dimer | $C_{38}$ | $C_{38}$ | $C_{38}$ | $C_{36-48}$ | $C_{36-48}$ | $C_{36-48}$ | $C_{36-48}$ |
| gm. dimer t.chloride | 10.7 | 10.7 | 10.7 | 6.0 | 6.0 | 6.0 | 6.0 |
| Aromatic* | B | DPE | BP | DPE | tBB | AB | HB |
| Amount Aromatic | .78 gm. | 1.70 ml. | 1.54 gm. | .8 ml | 78 ml. | 6.9 ml. | 7 gm. |
| ml. heptane, total | 60 | 60 | 60 | 35 | — | — | — |
| gm. $AlCl_3$ | .266 | .266 | .266 | .266 | — | — | .213 |
| gm. $FeCl_3$ | — | — | — | — | .648 | .328 | — |
| Temp., ° C. | 25–50 | 23–25 | 23–26 | 26–27 | 10–30 | 27–35 | 23–28 |
| Time, min. | 135 | 120 | 135 | 140 | 225 | 125 | 165 |

*Aromatic -
DPE - diphenyl ether
BP - biphenyl
B - benzene
BB - tertiary butyl benzene
AB - amyl benzene
HB - heptyl benzene The dimer alkylated aromatics were tested for pour depressing effect in home heating oil previously described according to the ASTM-D-97-66 pour point test.

The results are summarized in Table V which follows:

TABLE V

| Additive | Aromatics | Olefin Dimer | Wt. % | ASTM-D97 Pour, ° F. |
|---|---|---|---|---|
| 11 | diphenyl ether | $C_{32}$ | 0.3 | −10 |
| 12 | " | $C_{34}$ | 0.3 | −40 |
| 13 | " | $C_{36}$ | 0.3 | 70 |
| 14 | " | $C_{38}$ | 0.3 | < -75 |
| 14 | " | $C_{38}$ | 0.05 | −35 |
| 15 | " | $C_{40}$ | 0.3 | -45 |
| 16 | " | $C_{44}$ | 0.3 | -15 |
| 17 | " | $C_{36-40}$ | 0.3 | −65 |
| 18 | " | $C_{36-40}$ | 0.6 | −20 |
| 19 | benzene | $(C_{38})_2$ | 0.3 | −70 |
| 20 | diphenyl ether | $(C_{38})_2$ | 0.05 | −45 |
| 21 | " | $(C_{38})_2$ | 0.05 | -45 |
| 22 | " | $(C_{36-48})_2$ | 0.3 | −55 |
| 23 | t-butyl benzene | $C_{36-48}$ | 0.5 | -25 |
| 24 | n-pentyl benzene | $C_{36-48}$ | 0.5 | -25 |
| 25 | n-heptyl benzene | $C_{36-48}$ | 0.5 | -15 |
| 26 | m-diphenoxybenzene | $C_{38}$ | 0.6 | -40 |
| 28 | triphenyl methane | $C_{38}$ | 0.6 | -50 |
| 29 | 2-phenoxybiphenyl | $C_{38}$ | 0.6 | -40 |
| 30 | o-xylene | $C_{36-48}$ | 0.5 | -35 |
| none | – | – | – | 0 |

As seen by Table V, the various alkylated aromatics tested improved the cold flow of the heating oil, i.e. decreased the pour point. All the materials were monoalkylates, except those indicated by the parenthesis followed by the subscript two, which were dialkylates, e.g. Additive 19 was benzene dialkylated with the $C_{38}$ olefin dimer.

What is claimed is:

1. A composition comprising a major amount of a petroleum distillate fuel oil that has been improved in its cold flow properties by containing about 0.01 to 2 percent by weight of a cold flow improver selected from the group consisting of a dimer of a $C_{18}$ or $C_{19}$ alpha olefin, a polymer of such dimer, and an aromatic alkylated with a dimer of an alpha olefin selected from the group of dimers consisting of the $C_{32}$, $C_{34}$, $C_{36}$, $C_{38}$, $C_{40}$, and $C_{44}$ dimers, said aromatic being selected from the group consisting of benzene, benzene alkylated with from 1 to 20 carbon atoms in alkyl groups, triphenylmethane, a phenyl ether of benzene, and phenoxybiphenyl.

2. A composition according to claim 1, wherein said cold flow improver is a dimer of a $C_{18}$ alpha olefin.

3. A composition according to claim 1, wherein said cold flow improver is a dimer of a $C_{19}$ alpha olefin.

4. A composition according to claim 1, wherein said cold flow improver is the product of polymerizing the dimer of a $C_{19}$ alpha olefin.

5. A composition according to claim 1, wherein said cold flow improver comprises diphenyl ether alkylated with the dimer of an alpha olefin selected from the group of dimers consisting of the $C_{32}$, $C_{34}$, $C_{36}$, $C_{38}$, $C_{40}$, and $C_{44}$ dimers.

* * * * *